United States Patent [19]

Klosin et al.

[11] 4,382,651

[45] May 10, 1983

[54] TRANSFORMER BAR CONNECTOR

[75] Inventors: John J. Klosin; Eugene W. McGrane, both of Ormond Beach, Fla.

[73] Assignee: Homac Mfg. Company, Ormond Beach, Fla.

[21] Appl. No.: 170,142

[22] Filed: Jul. 18, 1980

[51] Int. Cl.[3] ..... H01R 4/30

[52] U.S. Cl. ..... 339/92 R; 339/94 R; 339/242; 339/272 R

[58] Field of Search ..... 339/92 R, 94 R, 94 C, 339/242, 263 R, 272 R, 272 A; 411/294, 295, 300, 315, 316

[56] References Cited

U.S. PATENT DOCUMENTS

| | | | |
|---|---|---|---|
| 3,350,677 | 10/1967 | Daum | 339/242 |
| 3,585,566 | 6/1971 | Sievert | 339/263 R |
| 3,794,963 | 2/1974 | Cooper, Jr. | 339/242 |
| 3,808,587 | 4/1974 | Lipp et al. | 339/242 |
| 4,214,806 | 7/1980 | Kraft | 339/242 |
| 4,266,460 | 5/1981 | Klimowicz | 411/315 |
| 4,274,692 | 6/1981 | Hoffman et al. | 339/94 R |

FOREIGN PATENT DOCUMENTS

| | | | |
|---|---|---|---|
| 1013047 | 6/1977 | Canada | 339/242 |
| 1028393 | 4/1958 | Fed. Rep. of Germany | 411/295 |

*Primary Examiner*—John McQuade
*Attorney, Agent, or Firm*—John E. Benoit

[57] ABSTRACT

A bar connector is provided whereby, when the connector is in a locked position on a transformer bushing, a set screw is provided having a conical tapered end. An internally threaded bore hole is selectively provided in the connector at a point such that, when the connector is secured on the transformer bushing, the tapered conical end of the set screw bears against the chamfer of the threaded stud of the transformer, thereby locking the connector in place without damaging the threads of the stud. By utilizing this method for locking the transformer stud, thus eliminating the present lock nut, a completely insulated and sealed transformer bus is gained. An insulating cover positioned at the threaded end of the bar connector provides a flexible cylindrical base which, under thread pressure, seals the juncture of the transformer bushing with the insulated end of the bar connector. After threading the bar connector over the transformer stud, the stud is locked in place, as previously described. A second, larger insulating cover is force fitted over the smaller cover to provide a completely insulated assembly.

6 Claims, 4 Drawing Figures

TRANSFORMER BAR CONNECTOR

This invention relates generally to transformer bar connectors, and more specifically to a connector which provides a positive lock by means of a set screw without damaging the threads of the transformer stud. This locking means is also used with a water tight seal at the juncture of the transformer bushing and the insulated connector.

BACKGROUND OF THE INVENTION

A problem which arises in an attempt to obtain a positive seal at the juncture of the transformer bushing and the connector relates to the means for locking the connector in place. Presently used lock nuts leave a portion of the transformer stud exposed. Eliminating the lock nut by threading a set screw directly to the threaded area of the transformer stud is impractical. Thread damage which would be imposed on the transformer stud makes it impossible to remove the connector assembly from the transformer stud.

Additionally, it has not been possible for the industry to have a completely insulated connection to transformer studs. Standard practice which is dictatec by the insulated connector designs presently available require that the connector be threaded onto the transformer stud with a lock nut tightened against the aluminum bar connecting element. This leaves the lock nut and a portion of the transformer stud exposed. The only known method of protection is to use a shroud to cover the stud and lock nut of the transformer bushing. However, such a shroud does not provide any sealing means, but is simply designed to prevent accidental contact with the live or energized parts.

Transformers using insulated connector assemblies are those common to underground distribution. These are either surface mounted on concrete or plastic pads, or they are installed subsurface in concrete or paper composition cylinders.

Where a transformer is mounted on a surface, it is enclosed in a steel cabinet. Due to condensation, moisture is always present. In subsurface installations, the possibility of flooding is a very real one. In either type of installation, the transformer studs are normally copper while the connector must be aluminum to accomodate the aluminum cables in common use today. The juncture of the aluminum connector body and the copper transformer stud presents the components for electrogalvanic action in the presence of an electrolyte. This dictates the great need for a means of sealing the stud connection so that the entire unit is completely sealed and free from the galvanic action initiated by moisture or flooding.

An object of the present invention is to provide a positive locking action for securing a connector to a transformer bushing without damaging the threaded stud extending from the transformer bushing.

Another object of the invention is to provide a means of making a seal at the juncture of the transformer bushing stud and the insulated connector.

It is a further object of this invention to provide a positive locking means for maintaining said sealed connection in place.

These and other objects of the invention will become apparent from the following description taken in conjunction with the drawings.

SUMMARY OF THE INVENTION

The present invention provides a means for maintaining the connector in a locked position on the transformer bushing. Removable locking means extends through said connector in pressure contact against a selected area of the bushing stud. In one configuration, a set screw is provided having a conical tapered end. An internally threaded bore hole is selectively provided in the aluminum rectangular bar at a point such that, when the connector is secured on the transformer bushing, the tapered conical end of the set screw bears against the chamfer of the threaded stud of the transformer, thereby locking the connector in place without damaging the threads of the stud.

The invention also provides an insulated bar connector with cable outlets and hardware apertures being sealed in a manner common to the art. At the end of the rectangular bar connector, which is normally of aluminum, there is provided a flexible insulating cover terminating at its outer end in a flange, such as a cylindrical boss. When the connector is threaded onto the threaded stud of the transformer bushing, the cylindrical boss flares out under pressure against the plastic or porcelain insulator end of the transformer bushing and provides a positive watertight seal. The above described locking means is then secured in place. By utilizing this method for locking the transformer stud, thus eliminating the present lock nut, a completely insulated and sealed transformer bus is gained. An insulating cover positioned at the threaded end of the bar connector provides a flexible cylindrical base which, under thread pressure, seals the juncture of the transformer bushing with the insulated end of the bar connector. After threading the bar connector over the transformer stud, the stud is locked in place, as previously described. A second, larger insulating cover is force fitted over the smaller cover to provide a completely insulated assembly.

DESCRIPTION OF A PREFERRED EMBODIMENT OF THE INVENTION

Figure 1:
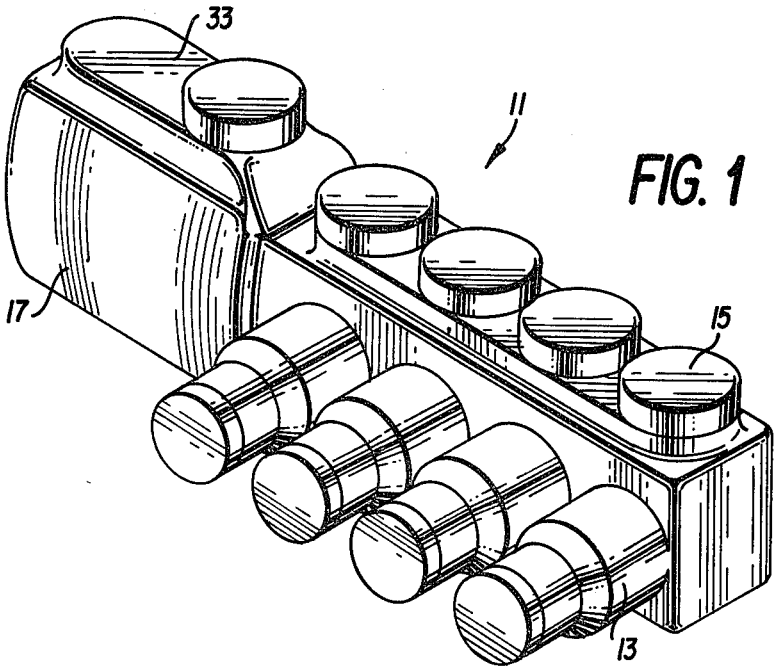
FIG. 1 is a perspective view of an insulated bar connector incorporating the present invention.

Turning now more specifically to the drawings, there is shown in FIG. 1 a perspective view of an insulated bar connector 11 which is used to carry the current from a transformer stud to cables to be energized. As indicated, the entire connector is covered by means of insulating sleeve 33 closed at one end. There are also shown cable reducer bushings 13 and insulating plugs 15 common to the art.

Figure 2:
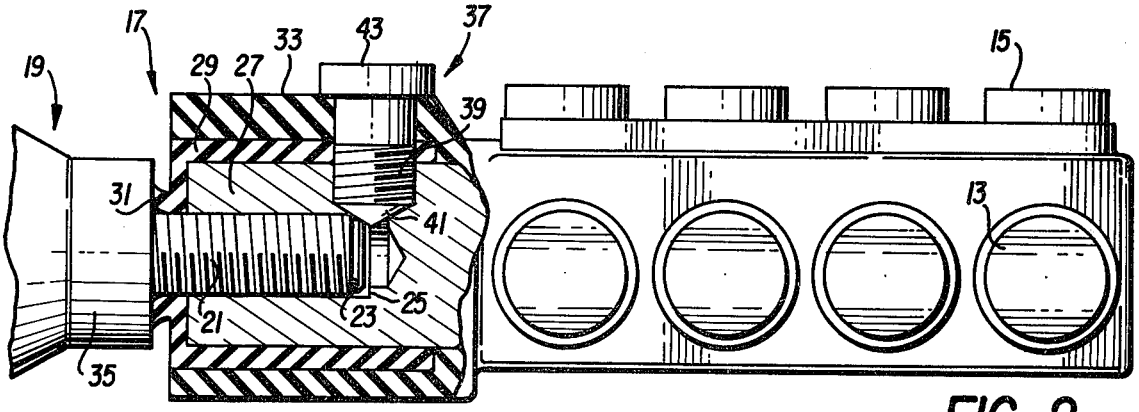
FIG. 2 is a partially broken away side view of the bar connector of FIG. 1 mounted to a transformer stud.
Figure 3:
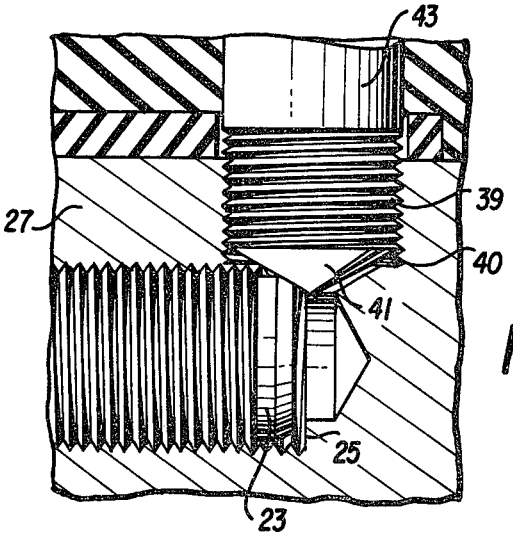
FIG. 3 is an enlarged view of the set screw locking configuration as shown in FIG. 2.

The details of the use of the connector relative to the transformer stud are shown more specifically in FIGS. 2 and 3. As shown therein, a transformer bushing 19 terminates in a threaded stud 21. The threaded stud, because of the manufacturing technique, terminates in a chamfer 23 at its outer end. Stud 21 mates with an internally threaded bore hole 25 in aluminum rectangular bar 27 which constitutes the body of the connector.

Terminal end 17 includes a flexible insulating cover 29, produced from resilient EPDM rubber or the like, which terminates at its outer end in cylindrical boss 31. Insulating sleeve 33 is then fitted over the entire connector assembly including that portion containing insulating cover 29.

As can be seen in FIG. 2, when bar connector 11 is screwed onto the transformer bushing 19, the outer end of cylindrical boss 31 flares outwardly under the exerted pressure, thus providing a positive watertight seal against the plastic or porcelain insulator at the end of the transformer bushing.

In order to lock connector 11 in the position shown in FIG. 2 without damaging the threads of stud 21, an internally threaded bore hole 40 is drilled into aluminum bar 27 at a location designed for mating purposes in a specific area with stud 21. In order to accomplish the locking condition, a set screw assembly 37 is provided which includes externally threaded set screw 39 which mates with internally threaded bore hole 40. Set screw 39 is specifically designed so as to terminate in a conically tapered end 41. When the connector is in place as shown in FIG. 3, set screw 39 is secured within aluminum rectangular bar 27 and advances until the taper of conical end 41 bears against transformer stud chamfer 23, thus positively locking the connector onto the stud. Sealing plug 43 is then inserted so as to cover set screw 39 which is of a sufficient diameter to allow for more than the maximum allowable tolerance in length of the transformer stud, which is established under industry standards.

Figure 4:
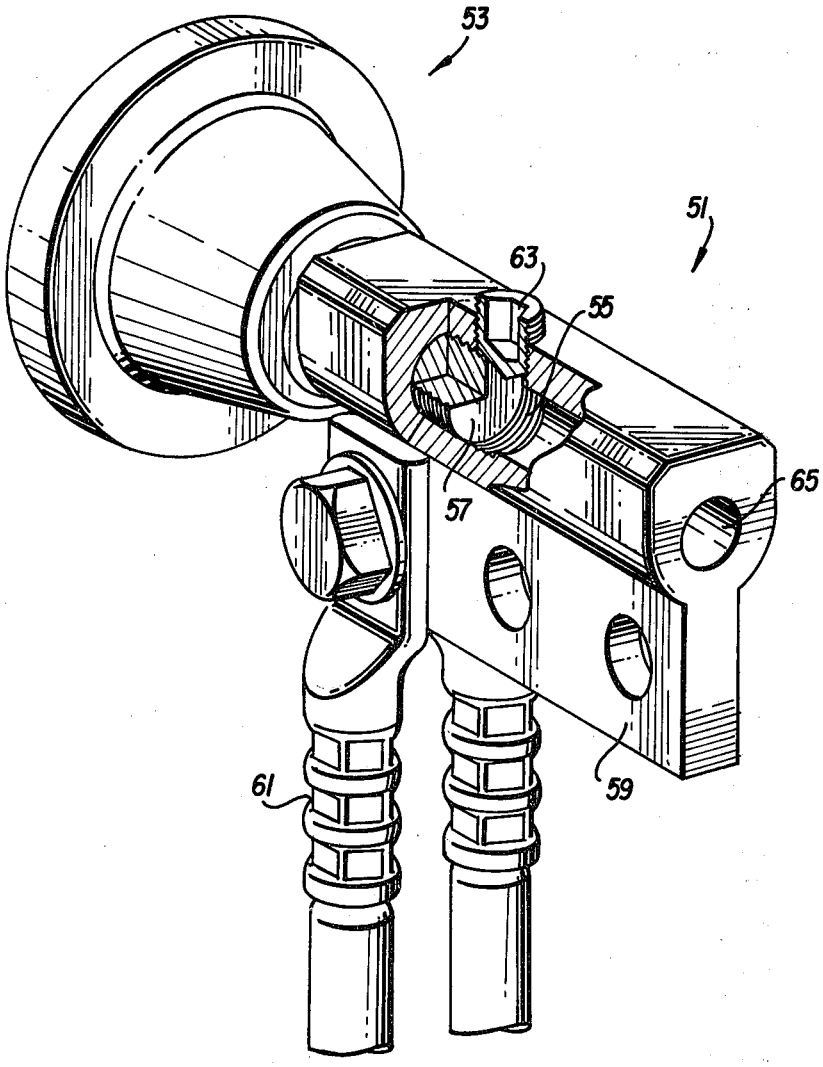
FIG. 4 is a partial cut-away view of the present invention as used with an uninsulated connector.

FIG. 4 is a perspective view of an uninsulated connector as mounted on a transformer bushing. As will be noted, the connector 51 is mounted directly to the bushing 33 and does not require an additional lock nut between the two elements. The connector 51 has an internally threaded bore hole 55 which receives the externally threaded stud 57 of the transformer. In this particular configuration, the connector 51 has an extending bus 59 which accepts cables 61. Also in this configuration, the connector has a bore hole 65 extending to the outer end thereof. The provision of the connector as shown in FIG. 4 provides the advantage that, in eliminating the lock nut, the thread engagement area in the transformer stud connection may be extended considerably. The added thread engagement in a $\frac{5}{8}$ inch stud is 25% and on 1 inch stud is 30%. This additional threaded length provides for cooler, lower resistance electrical connections and increases the mechanical strength in the overall connection. This latter provision is very important where short circuits are involved. The above advantages are accomplished by being able to use the set screw configuration of the present invention without damaging the threaded stud of the transformer. The set screw provides a positive lock in the same manner as is provided by a standard lock nut, but effectively provides the listed advantages without sacrificing any of the locking features.

This invention also provides a reliable means for making a seal at the juncture of the transformer bushing stud and the insulator connector, thereby making it possible to obtain a completely insulated transformer connection. This is made possible by employing the locking action at the forward end of the end of the transformer stud together with the cylindrical boss which flares out under pressure so as to provide a positive seal.

The above description and drawings are illustrative only since modification could be made in the component parts without departing from the scope of the invention which is to be limited only by the following claims.

We claim:

1. A bar connector for connection to a transformer bushing having a threaded stud which terminates in a chamfer comprising a connector body including cable attachment means;

a first internally threaded bore hole in one end of said body for mating with said threaded stud;

a second internally threaded bore hole in said body substantially perpendicular to said first bore hole and intersecting said first bore hole at the inner end therefor; and a set screw terminating in a substantially conical end surface secured within said second bore hole;

said conical end surface of said set screw bearing against said chamfer of said threaded stud when the connector is in place on said bushing, thereby locking said connector to said bushing.

2. A bar connector for connection to a transformer bushing having a threaded stud which terminates in a chamfer comprising a connector body including cable reducer bushings;

a first internally threaded bore hole in one end of said body for mating with said threaded stud;

a flexible insulating cover about said one end of said body and terminating in a cylindrical boss extending from said one end and substantially axially aligned with said first bore hole, said boss pressing against said transformer bushing in a flared out position when said connector is in place on said bushing;

a second internally threaded bore hole in said body substantially perpendicular to said first bore hole and intersecting said first bore hole at the inner end thereof; and an externally threaded removeable set screw terminating in a substantially conical end surface, said set screw being of a dimension to mate with said second internally threaded bore hole;

said conical end surface of said set screw bearing against the chamfer of said threaded stud when said connector is in place on said bushing, thereby locking said connector to said bushing.

3. A bar connector for connection to a transformer bushing having a threaded stud which terminates in a chamfer comprising a connector body including cable reducer bushings;

a first internally threaded bore hole in one end of said body for mating with said threaded stud;

a flexible insulating cover about said one end of said body and terminating in a flange extending from said one end about said first bore hole, said flange bearing against said transformer bushing when said connector is in place on said bushing;

a second internally threaded bore hole in said body substantially perpendicular to said first bore hole and intersecting said first bore hole at the inner end thereof; and an externally threaded removable set screw terminating in a conical bearing surface, said set screw being of a dimension to mate with said second internally threaded bore hole;

said conical bearing surface of said set screw abutting against the chamfer of said threaded stud when said connector is in place on said bushing, thereby locking said connector to said bushing.

4. The connector of claim 3 wherein said flange comprises a cylindrical boss which flares outwardly when it bears against said transformer bushing.

5. A bar connector for connection to a transformer bushing having a threaded stud which terminates in a chamfer comprising a connector body including cable attachment means;

a first internally threaded bore hole in one end of said body for mating with said threaded stud;

a flexible insulating cover about said one end of said body and terminating in a flange extending from said one end and substantially axially aligned with said first bore hole, said flange bearing against said transformer bushing when said connector is in place on said bushing;

a second internally threaded bore hole in said body substantially perpendicular to said first bore hole and intersecting said first bore hole at the inner end thereof; and a set screw terminating in a substantially conical end surface removably secured within said second bore hole;

said conical end surface of said set screw bearing against said chamfer of said threaded stud when said connector is in place on said bushing, thereby locking said connector to said bushing.

6. The bar connector of claim 5 further comprising an insulating sleeve fitted over said connector body and closed at the end opposite said first internally threaded bore hole.

* * * * *